US005538341A

United States Patent [19]

Padgett et al.

[11] Patent Number: 5,538,341

[45] Date of Patent: Jul. 23, 1996

[54] APPARATUS FOR MIXING

[75] Inventors: Paul O. Padgett, Duncan; Lanny R. Landram, Marlow; Perry A. Jones, Duncan, all of Okla.

[73] Assignee: Halliburton Company, Duncan, Okla.

[21] Appl. No.: 440,404

[22] Filed: May 12, 1995

[51] Int. Cl.[6] ..... B01F 15/02

[52] U.S. Cl. ..... 366/134; 366/136; 366/177.1

[58] Field of Search ..... 366/2, 8, 6, 9, 366/16, 27, 36, 37, 40, 134, 136, 137, 137.1, 158.5, 159.1, 162.4, 167.1, 173.1, 174.1, 175.2, 181.5, 337, 177.1

[56] References Cited

U.S. PATENT DOCUMENTS

| | | | |
|---|---|---|---|
| 3,563,517 | 2/1971 | Harriman . | |
| 3,741,533 | 6/1973 | Winn, Jr. | 366/136 |
| 4,007,921 | 2/1977 | Zingg | 366/136 |
| 4,086,663 | 4/1978 | Croft | 366/137.1 |
| 4,125,331 | 11/1978 | Chisholm | 366/137 |
| 4,323,324 | 4/1982 | Kaiser-Wirz | 366/137.1 |
| 4,453,832 | 6/1984 | Schumacher et al. | 366/337 |
| 4,490,047 | 12/1984 | Stegemoeller et al. | 366/132 |
| 4,538,921 | 9/1985 | Kennedy | 366/136 |
| 4,802,141 | 1/1989 | Stegemoeller et al. | 366/132 |
| 4,930,576 | 6/1990 | Berryman et al. | 166/308 |
| 4,951,262 | 8/1990 | Phillippi et al. | 366/279 |
| 4,979,829 | 12/1990 | Allen | 366/66 |
| 4,989,987 | 2/1991 | Berryman et al. | 366/65 |
| 5,026,168 | 6/1991 | Berryman et al. | 366/168 |
| 5,029,645 | 7/1991 | Allen | 166/286 |
| 5,046,855 | 9/1991 | Allen et al. | 366/137 |
| 5,073,032 | 12/1991 | Berion et al. | 366/137.1 |
| 5,103,908 | 4/1992 | Allen | 166/285 |
| 5,114,239 | 5/1992 | Allen | 366/6 |
| 5,190,374 | 3/1993 | Harms et al. | 366/165 |

FOREIGN PATENT DOCUMENTS

| | | | |
|---|---|---|---|
| 2813865 | 10/1978 | Germany | 366/134 |

OTHER PUBLICATIONS

Halliburton Services publication entitled "RCM© Mixing System," dated at least one year prior to the filing date.

Halliburton Services publication entitled "RCM II System," dated at least one year prior to the filing date.

Halliburton Services Sales & Service Catalog No. 40, dated at least one year prior to the filing date.

Halliburton Services Sales & Service Catalog No. 41, dated at least one year prior to the filing date.

*Primary Examiner*—David Scherbel
*Assistant Examiner*—Tony G. Soohoo
*Attorney, Agent, or Firm*—Craig W. Roddy; Stephen R. Christian; Michael J. LaBrie

[57] ABSTRACT

The apparatus of the present invention includes a mixing tube and inlets for conveying substances into the mixing tube such that the components intersect at a common point. A replaceable insert directs a dry component into the mixing tube. A liquid inlet bi-directionally sprays a liquid component between a wall of the mixing tube and the insert and toward the common point. A recirculation inlet directs a recirculated component toward the common point. Mixing is enhanced by a flow deflector and a flow interceptor which converge and turn the substances. The method of the present invention includes conveying substances into a mixing tube and intersecting the substances at a common point in the mixing tube to form a mixture.

38 Claims, 3 Drawing Sheets

APPARATUS FOR MIXING

BACKGROUND OF THE INVENTION

This invention relates generally to apparatus and methods for mixing and more particularly, but not by way of limitation, to apparatus and methods for mixing substances, such as a dry substance and a liquid substance like bulk cement and water, respectively, to form a cement slurry for use in the wellbore of an oil or gas well.

Both land based and offshore well drilling and completion operations often require on-site mixing of substances, such as cement slurries, acids and fracturing gels and weighting drilling fluids. In general, a mixing system includes a tub, pumps and various monitoring and control equipment. Also, an apparatus and method for introducing substances into the tub is part of the mixing system.

Prior art apparatus and methods of mixing include a jet mixer. A jet mixer typically sprays water under pressure into a venturi tube where bulk cement is added. The water and bulk cement combine to form a cement slurry, which is conveyed into a tub prior to pumping the slurry down a wellbore.

Another prior art mixer is an axial flow mixer such as that shown in U.S. Pat. No. 5,046,855, which is incorporated by reference herein. An axial flow mixer combines water, cement and recirculated slurry in an axial mixing tube to form a mixture. The prior art recognizes the benefit of adding recirculated slurry in order to increase the density and uniformity of the cement mixture. The mixture is then deposited in a tub prior to pumping the slurry down a wellbore.

While the prior art apparatus and methods for mixing provide satisfactory results, there are nonetheless shortcomings. For example, some prior art devices require numerous machined components which contribute to a complex device which is difficult and expensive to maintain. These parts must be frequently replaced due to the high wear associated with mixing a cement slurry. Furthermore, many prior art devices are large and bulky.

Moreover, the prior art devices inefficiently use the mixing energy which can result in an inconsistent mixture containing lumps of dry cement and pockets of air or air entrainment in the cement slurry. Additionally, incomplete mixing can cause cement dust to escape from the mixer.

Thus, there is a need for improved apparatus and methods for mixing which are cost effective, relatively inexpensive, low maintenance, simple and which effectively mix without dusting by efficiently using the available mixing energy.

SUMMARY OF THE INVENTION

The present invention provides improved apparatus and method for mixing which meet the need described above and overcome the shortcomings of the prior art.

The present invention includes an apparatus for mixing substances comprising a mixing tube and first means for conveying a first substance, second means for conveying a second substance and third means for conveying a third substance to a common point of intersection within the mixing tube such that a mixture is formed.

The present invention also includes an apparatus for mixing components comprising a mixing tube, a bulk inlet for conveying a dry component into the mixing tube and liquid inlet means for directing a liquid component between the bulk inlet and a wall of the mixing tube to clean and toward a lower portion of the mixing tube to mix with the dry component.

The present invention also includes an apparatus for mixing substances comprising a mixing tube, means for conveying the substances into the mixing tube and a flow deflector for turning the substances to enhance mixing in the mixing tube.

The present invention also includes a slurry mixing apparatus for use at a well site comprising a replaceable insert for conveying an abrasive component into a mixing tube, wherein the abrasive component mixes with a water component and a recirculated component to form a slurry in the mixing tube.

The present invention also includes a method of mixing substances comprising conveying a first substance, a second substance and a third substance into a mixing tube and intersecting the first substance, the second substance and the third substance at a common point in the mixing tube to form a mixture.

It is therefore a general object of the present invention to provide improved apparatus and methods for mixing. Other and further objects, features and advantages of the present invention will be readily apparent to those skilled in the art upon a reading of the following disclosure when taken in conjunction with the accompanying drawings.

BRIEF DESCRIPTION OF THE DRAWINGS

FIG. 8 is a schematic of an apparatus and system of the present invention.

DETAILED DESCRIPTION OF THE PREFERRED EMBODIMENTS

Figure 1:
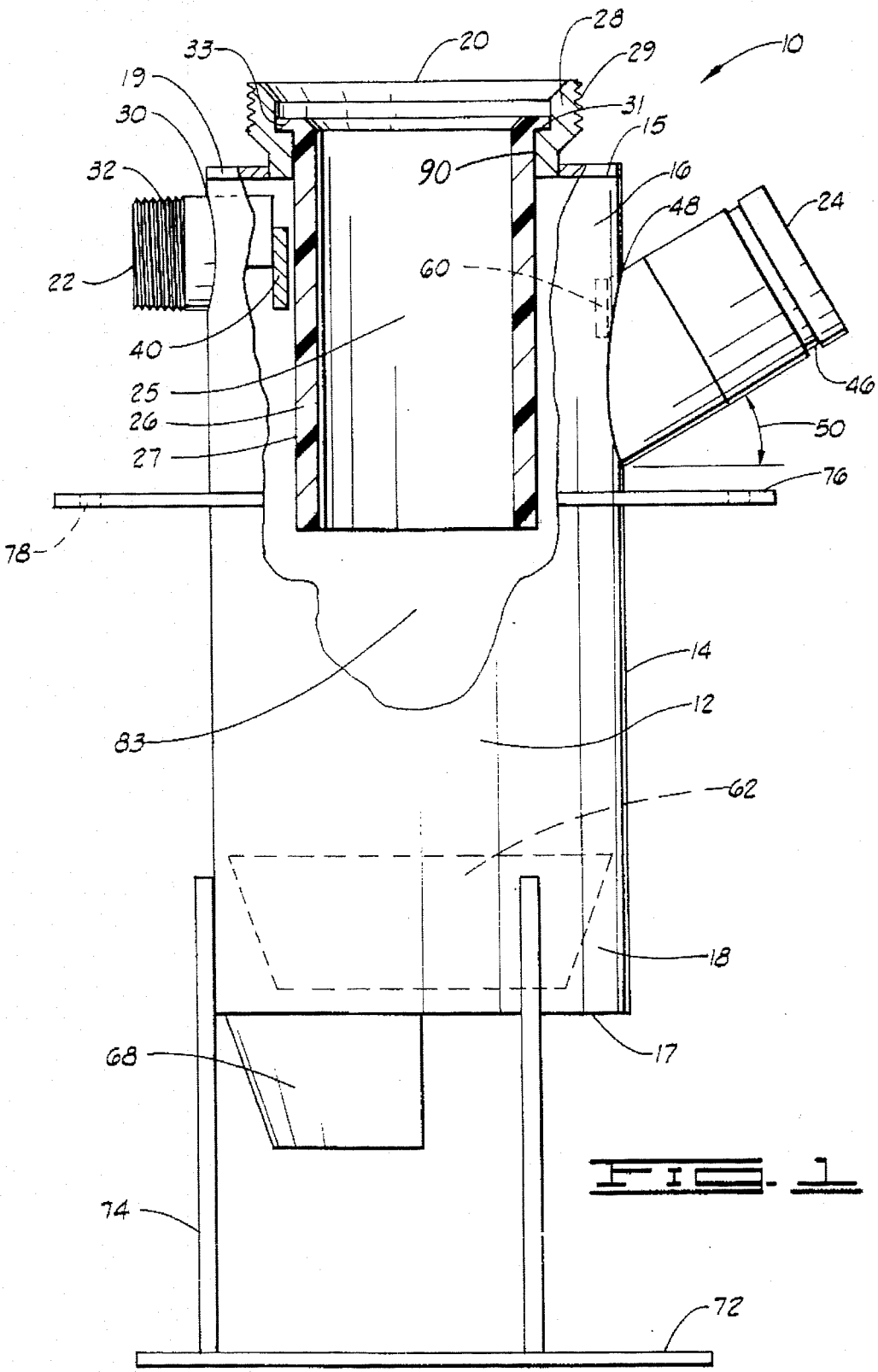
FIG. 1 is a partially sectioned side elevational view of an apparatus of the present invention.

Referring to the drawings, a presently preferred embodiment of the invention and its operation are illustrated. Like reference numerals refer to like parts throughout the drawings and this description.

Referring to FIG. 1, a presently preferred apparatus for mixing is illustrated and generally designated by the numeral 10. Apparatus 10 includes mixing tube 12 wherein substances are introduced and initially mixed. While mixing tube 12 preferably has a tubular shape, it can also have a different shape such as frusto conical, conical or rectangular. Mixing tube 12 includes cylindrical wall 14 having first end 15 and second end 17. Mixing tube 12 also includes upper portion 16 and lower portion 18. The designation of upper portion 16 and lower portion 18 is provided for simplicity and use of these terms shall not restrict mixing tube 12 to a vertical orientation. While in a preferred embodiment mixing tube 12 is vertically oriented, other orientations are also possible.

Apparatus 10 also includes means for conveying substances into mixing tube 12. More specifically, the preferred embodiment includes first means for conveying a first substance, second means for conveying a second substance and third means for conveying a third substance into mixing tube 12. In a cement slurry mixing application, the first substance includes dry or bulk cement, the second substance includes water and the third substance includes a recirculated mixture of cement slurry.. In a preferred embodiment used for the application of mixing a cement slurry, bulk inlet 20 conveys a dry cement component into mixing tube 12, liquid inlet 22 conveys a liquid component such as water into mixing tube 12 and recirculation inlet 24 conveys a recirculated mixture of cement slurry into mixing tube 12.

Bulk inlet 20 is disposed at or near upper portion 16 of mixing tube 12. Bulk inlet 20 includes replaceable insert 26 which extends toward lower portion 18 of mixing tube 12. Insert 26 includes central opening 25 axially disposed therethrough, has cylindrical wall 27 and flange 33 defined on an end of insert 26.

Apparatus 10 includes ring 19 attached to first end 15 of wall 14 of mixing tube 12 by welding or other suitable means. Collar 28 is attached to ring 19. Collar 28 includes external threads 29 and internal annular shoulder 31. For installation, insert 26 slides through central opening 90 of collar 28 until flange 33 of insert 26 engages annular shoulder 31 of collar 28. Insert 26 is accessible for removal by removing a cement throttling valve (not shown) which may be attached to collar 28 by threads 29. Insert 26 can then be removed by hand. When insert 26 is removed, there is complete access to an inside of apparatus 10 for inspection and clean-up.

In a cement slurry mixing application, bulk inlet 20 conveys dry or bulk cement into mixing tube 12. Bulk cement is abrasive and causes considerable erosion and wear when it is transferred. Accordingly, insert 26 is adapted to be replaced when insert 26 becomes worn. While replaceable insert 26 can be formed from any number of materials which are abrasion and wear resistant, a specific material is sold under the brand name NYLATRON which is available from vendors such as Industrial Gasket in Oklahoma City, Okla. A particularly preferred material is an ultra high molecular weight polyethylene.

The length and location of various parts provides variance in the quality and efficiency of mixing in apparatus 10. Insert 26 preferably has a length which minimizes splashback of cement slurry and which conveys the bulk cement toward lower portion 18 of the mixing tube such that the bulk cement can be angularly intersected by the recirculated component. In a particular implementation of a preferred embodiment insert 26 has a length within the range from about seven inches to about eight inches. More importantly, insert 26 preferably extends below a lowest point of bulk inlet 24 a distance in the range from about zero inches to about one inch, preferably about ⅝ inch.

As shown in FIG. 1, liquid inlet 22 is disposed through bore 30 in wall 14 in upper portion 16 of mixing tube 12. Liquid inlet 22 has threads 32 for connecting a water line with a water metering valve (not shown). Liquid inlet 22 bi-directionally sprays a liquid component. A first stream or flow is directed toward an area near upper portion 16 and partially bounded by replaceable insert 26, wall 14, ring 19 and an end of collar 28. This first stream or flow of the liquid component reduces or prevents "dusting", that is, the escape of dry cement out of apparatus 10, by wetting cement dust in upper portion 16 of mixing tube 12 so that the wetted mixture of cement dust falls toward lower portion 18 to join with other components. The first stream or flow of the liquid component also cleans the area such that cement slurry which splashes back in this area does not harden.

A second stream or flow is directed from liquid inlet 22 toward lower portion 18 to intersect with the bulk cement and the recirculated component at common point 83 as is later explained in detail. Accordingly, the bi-directional spray aspect of liquid inlet 22 reduces or prevents dusting, maintains apparatus 10 in a clean condition and aids in efficient mixing.

Figure 2:
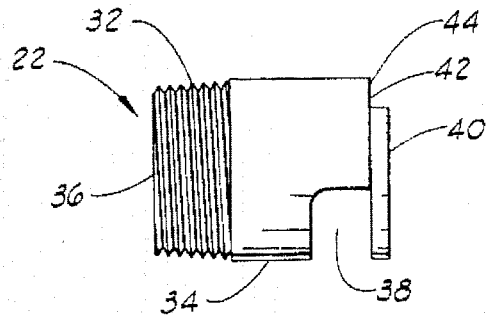
FIG. 2 is a side view of a liquid inlet.
Figure 3:
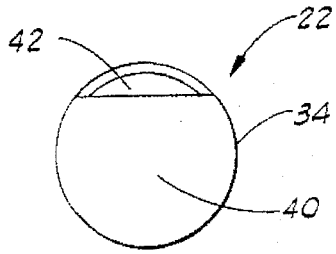
FIG. 3 is an end view of the liquid inlet.

Referring to FIGS. 2 and 3, further detail of a particular liquid inlet 22 is shown. This implementation includes cylindrical wall 34 having a bore 36 defined therethrough. Wall 34 is formed or machined to define a cut-out portion 38 which is a semi-circular strip such that a wrapped (i.e., flat) view of cut-out portion 38 is approximately rectangular in shape. Liquid nozzle plate 40 is attached, such as by welding or other suitable means, to end 44 of cylindrical wall 34. Liquid nozzle plate 40 is a truncated circular shape. Liquid nozzle plate 40 has a diameter substantially the same as an outside diameter of cylindrical wall 34 of liquid inlet 22. When attached to end 40 of cylindrical wall 34, liquid nozzle plate 40 forms gap 42 which is oriented toward upper portion 16 of mixing tube 12. Cut-out portion 38 is oriented toward lower portion 18 of mixing tube 12. Thus, the first stream or flow of the component is directed between wall 14 of mixing tube 12 and insert 26 from gap 42 and the second stream or flow of the liquid component is directed toward lower portion 18 of mixing tube 12 from cut-out portion 38.

Referring to FIG. 1, recirculation inlet 24 is disposed through bore 48 in wall 14 in upper portion 16 of mixing tube 12. Recirculation inlet 24 is angled toward lower portion 18 at an approximate 30° angle 50, such that the recirculated substance is directed toward lower portion 18 of mixing tube 12.

Figure 4:
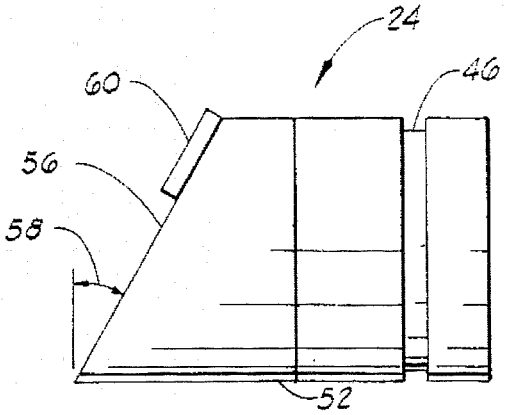
FIG. 4 is a side view of a recirculation inlet.
Figure 5:
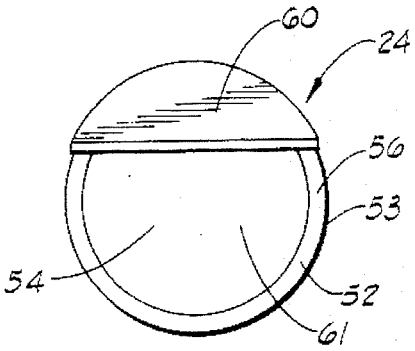
FIG. 5 is an end view of the recirculation inlet.

FIGS. 4 and 5 show additional detail of a particular recirculation inlet 24. This implementation comprises cylindrical wall 52 having bore 54 defined therethrough. Circumferential groove 46 is radially defined in exterior surface 53 of cylindrical wall 52 for connecting a recirculation line (not shown). Recirculation inlet 24 includes end 56 angled at an approximate 30° angle 58. Recirculation inlet 24 also includes recirculation nozzle plate 60 attached to end 56 of cylindrical wall 52 by welding or other suitable means. Recirculation nozzle plate 60 is semi-circular in shape with a diameter substantially the same as an outside diameter of cylindrical wall 52 of recirculation inlet 24. Since recirculation nozzle plate 60 incompletely covers end 56 of cylindrical wall 52, opening 61 (FIG. 5) is provided.

Opening 61 is oriented toward lower portion 18 of mixing tube 12. The recirculated component is directed through opening 61 toward lower portion 18 of mixing tube 12 due to interference with the normal flow by recirculation nozzle plate 60, due to the angular positioning of recirculation inlet 24 at 30° angle 50, and due to gravity if mixing tube 12 has a positive axial component (i.e., if mixing tube 12 is not inverted).

Due to 30° angle 50 shown in FIG. 1 and 30° angle 58 shown in FIG. 4, end 56 of recirculation inlet 24 can be and preferably is positioned approximately flush with an inside surface of wall 14 of mixing tube 12.

As shown in FIG. 1, apparatus 10 also includes flow deflector 62 attached by suitable means, such as by spot welding, to an inside surface of wall 14 of mixing tube 12. Flow deflector 62 is preferably located in lower portion 18 of mixing tube 12, that is, far enough below insert 26 so that splashback does not occur. Flow deflector 62 enhances mixing in mixing tube 12 by "turning" the substances. As used herein, "turning" the substances means turbulently churning the substances such that the substances are further mixed. A plurality of flow deflectors 62 can be attached to mixing tube 12.

Figure 6:
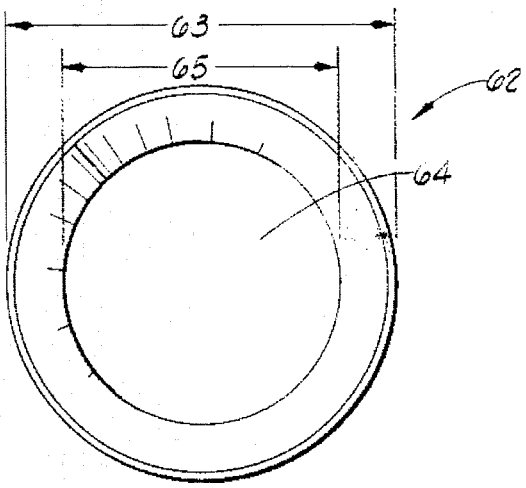
FIG. 6 is a plan view of a flow deflector.
Figure 7:
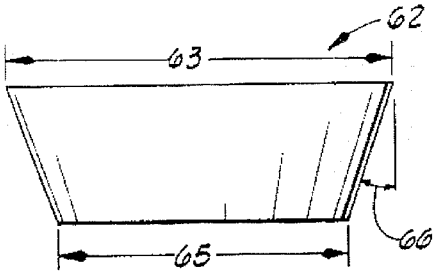
FIG. 7 is a side view of the flow deflector.
Figure 3:
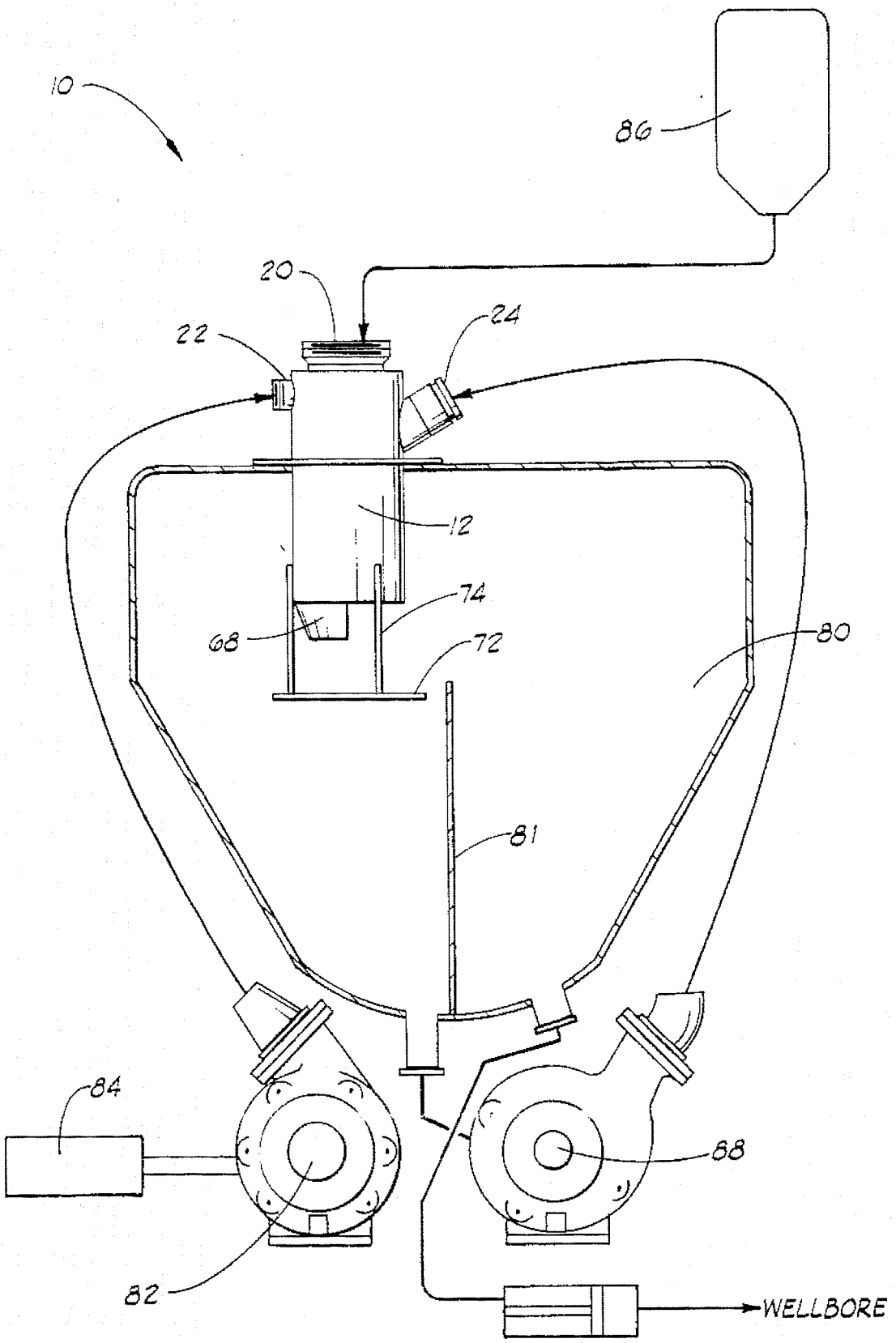

FIGS. 6 and 7 show flow deflector 62 in greater detail. Flow deflector 62 has a frusto conical shape with bore 64 disposed therethrough. Flow deflector 62 has an approximate 20° angle 66 as shown in FIG. 7. Due to the frusto conical shape, flow deflector 62 has first diameter 63 and second diameter 65 as shown in FIGS. 6 and 7. First diameter 63 is substantially equivalent to an inside diameter of wall 14 of mixing tube 12. First diameter 63 is oriented toward upper portion 16 of mixing tube 12 and second diameter 65 is oriented toward lower portion 18 of mixing tube 12 such that flow deflector 62 converges the flow.

Apparatus 10 also includes flow interceptor 68 attached, such as by spot welding, to lower portion 18 or end 70 of mixing tube 12 as shown in FIG. 1. Flow interceptor 68 enhances mixing by intercepting a portion of the flow of the substances from flow deflector 62. Flow interceptor 68 is equivalent to one-half of flow deflector 62 shown in FIGS. 6 and 7. That is, flow interceptor 68 extends 180° whereas flow deflector 62 extends 360°. A flow interceptor 68 extending 3600 has been found to undesirably choke the flow from the mixing tube 12, thereby creating a back pressure. As shown in FIG. 1, flow interceptor 68 is preferably attached opposite recirculation inlet 24 due to the high volume flow from recirculation inlet 24 relative to the flow from liquid inlet 22.

As shown in FIG. 1 apparatus 10 also includes deflector plate 72 suspended below second end 17 of mixing tube 12 by rods 74. In a particular implementation deflector plate 72 is preferably positioned five inches below second end 17 of mixing tube 12 so that a relatively wide, 360° opening exists. Rods 74 are attached to deflector plate 72 and to an outside surface of wall 14 of mixing tube 12 by welding or other suitable means. Deflector plate 72 reduces air entrapment in a mixture of the substances located in tub 80 (FIG. 8) adjacent or below mixing tube 12. Deflector plate 72 reduces air entrapment by diffusing the mixture, thereby preventing the mixture which flows from mixing tube 12 from jetting into the mixture which is located in tub 80 (FIG. 8). Deflector plate 72 also enhances mixing due to the impact of the mixture against deflector plate 72.

Many different types of tub 80 can be used such as standard 8 bbl tub 80 divided by partition 81 (FIG. 8). Partition 81 acts as a weir over which the mixture flows when it reaches a certain height.

Apparatus 10 also includes attachment plate 76 (FIG. 1) for attaching mixing tube 12 to tub 80 (FIG. 8). Attachment plate 76 has a central bore through which mixing tube 12 is disposed and a plurality of bores 78 for attaching deflector plate 72 to mixing tub 80 (FIG. 8) with bolts or other suitable means. Attachment plate 76 is attached to an outside surface of wall 14 of mixing tube 12 by welding or other suitable means. When apparatus 10 is attached to mixing tub 80 by attachment plate 76, part of apparatus 10 is suspended in tub 80, such that deflector plate 72 is preferably positioned approximately two inches below a top of partition 81 in one particular implementation.

FIG. 8 schematically illustrates use of a preferred embodiment in a typical cement slurry mixing application. Mixing tube 12 is vertically oriented and attached to tub 80. Centrifugal pump 82 pumps water from water storage unit 84 to liquid inlet 22. Pneumatically driven bulk cement enters bulk inlet 20 from bulk storage unit 86. Centrifugal pump 88 pumps cement slurry from tub 80 to recirculation inlet 24.

The water, the cement and the recirculated slurry are conveyed into mixing tube 12 and intersect at common point 83 (FIG. 1). "Common point" as used herein refers to a locus in mixing tube 12 where streams of water, cement and recirculated slurry initially intersect and form a mixture. It is estimated that approximately 75% of the volume of the input components initially intersect at common point 83. The remainder of the components mix below common point 83, such as near flow deflector 62 and deflector plate 72. Intersecting components at common point 83 makes efficient use of the available mixing energy.

The substances, including the mixture formed at common point 83, continue toward lower portion 18 of mixing tube 12. These interact with flow deflector 62 where the flow is converged, turned and further mixed. Flow interceptor 68 intercepts a portion of the mixture from flow deflector 62 and turns and further mixes the mixture.

Deflector plate 72 is impacted by the mixture, thereby further enhancing mixing. Deflector plate 72 deflects and diffuses the slurry mixture into tub 80 in order to reduce air entrapment that would be caused if the slurry mixture streamed unabated into tub 80.

An agitator (not shown) can be used to circulate and further mix the slurry mixture in tub 80. Slurry flows over partition 81 in tub 80. The cement slurry can now be pumped down the wellbore, typically using a positive displacement pump. The cement slurry is also continuously recirculated by centrifical pump 88 to again combine with water and bulk cement at common point 83 of intersection in mixing tube 12.

Apparatus 10 is designed to replace existing mixers by simply bolting mixing tube 12 and associated structure to an existing tub 80. Apparatus 10 can also be incorporated as a component of a continuous mixing system such as that shown in U.S. Pat. No. 5,114,239, herein incorporated by reference.

While the invention disclosed herein is discussed primarily in the context of mixing a cement slurry at a well site, it will be recognized by those skilled in the art that the apparatus and method for mixing can be used for mixing other substances at a well site as well as in other applications.

Thus, the present invention is well adapted to carry out the objects and attain the ends and advantages mentioned as well as those inherent therein. While preferred embodiments of the present invention have been illustrated for the purposes of the present disclosure, changes in the arrangement and construction of parts and the performance of steps can be made by those skilled in the art, which changes are encompassed within the scope and spirit of the present invention as defined by the appended claims.

What is claimed is:

1. A mixing apparatus, comprising:

a mixing tube having an attached collar;

first means for conveying a dry substance into said mixing tube wherein said first means includes a replaceable insert constructed of an ultra high molecular weight polyethylene; said insert is received through an opening of said collar until a flange of said insert engages an annular shoulder of said collar, second means for conveying a liquid substance into said mixing tube;

third means for conveying a recirculated mixture of said dry and liquid substances into said mixing tube; and wherein said dry substance, said liquid substance and said recirculated mixture are delivered to a common point of intersection within said mixing tube such that a mixture is formed.

2. The apparatus of claim 1 wherein said insert extends a distance in the range from about zero inches to about one inch below a lowest point of said second means for conveying.

3. A mixing apparatus, comprising:

a mixing tube;

first means for conveying a dry substance into said mixing tube;

second means for conveying a liquid substance into said mixing tube wherein said second means includes a cylindrical wall having a bore defined therethrough, said wall having a liquid nozzle plate attached to an end thereof and a cut-out portion;

third means for conveying a recirculated mixture of said dry and liquid substances into said mixing tube; and wherein said dry substance, said liquid substance and said recirculated mixture are delivered to a common point of intersection within said mixing tube such that a mixture is formed.

4. The apparatus of claim 3 wherein a wrapped view of said cut-out portion is approximately rectangular in shape.

5. The apparatus of claim 3 wherein said liquid nozzle plate is a truncated circular shape.

6. The apparatus of claim 3 wherein said liquid nozzle plate has a diameter substantially the same as an outside diameter of said cylindrical wall.

7. The apparatus of claim 3 wherein said liquid nozzle plate forms a gap oriented toward an upper portion of said mixing tube.

8. The apparatus of claim 3 wherein said cut-out portion is oriented toward a lower portion of said mixing tube.

9. A mixing apparatus, comprising:

a mixing tube;

first means for conveying a dry substance into said mixing tube;

second means for conveying a liquid substance into said mixing tube;

third means for conveying a recirculated mixture of said dry and liquid substances into said mixing tube wherein said third means includes a recirculation inlet angled toward a lower portion of said mixing tube, said recirculation inlet having a recirculation nozzle plate attached to an end thereof; and wherein said dry substance, said liquid substance and said recirculated mixture are delivered to a common point of intersection within said mixing tube such that a mixture is formed.

10. The apparatus of claim 9 wherein said recirculation inlet is angled at an approximate 30° angle.

11. The apparatus of claim 9 wherein said recirculation nozzle plate is semi-circular.

12. The apparatus of claim 9 wherein said recirculation nozzle plate has a diameter substantially the same as an outside diameter of said recirculation inlet.

13. The apparatus of claim 9 wherein said recirculation nozzle plate is positioned approximately flush with an inside surface of said mixing tube.

14. A mixing apparatus, comprising:

a mixing tube;

first means for conveying a dry substance into said mixing tube;

second means for conveying a liquid substance into said mixing tube;

third means for conveying a recirculated mixture of said dry and liquid substances into said mixing tube;

wherein said dry substance, said liquid substance and said recirculated mixture are delivered to a common point of intersection within said mixing tube such that a mixture is formed; and a flow deflector located inside said mixing tube for enhancing the mixing of said substances therein.

15. The apparatus of claim 14 wherein said flow deflector is a frusto conical shape and has bore disposed therethrough.

16. The apparatus of claim 14 wherein said flow deflector has an approximate 20° angle.

17. The apparatus of claim 14 wherein said flow deflector has a first diameter substantially equivalent to an inside diameter of said mixing tube and oriented toward an upper portion of said mixing tube, and a second diameter oriented toward a lower portion of said mixing tube such that said flow deflector converges the mixed substances.

18. A mixing apparatus, comprising:

a mixing tube;

first means for conveying a dry substance into said mixing tube;

second means for conveying a liquid substance into said mixing tube;

third means for conveying a recirculated mixture of said dry and liquid substances into said mixing tube;

wherein said dry substance, said liquid substance and said recirculated mixture are delivered to a common point of intersection within said mixing tube such that a mixture is formed;

a flow deflector located inside said mixing tube for enhancing the mixing of said substances in said mixing tube; and a flow interceptor attached to said mixing tube for enhancing the mixing of said substances, said flow interceptor enhances mixing by intercepting a portion of said mixed substances from said flow deflector.

19. The apparatus of claim 18 wherein said flow interceptor is positioned opposite said third means for conveying the recirculated mixture.

20. The apparatus of claim 18 wherein flow interceptor extends about 180° and said flow deflector extends about 360°.

21. The apparatus of claim 18 wherein flow interceptor is approximately equivalent to one-half the size of said flow deflector.

22. A mixing apparatus, comprising:

a mixing tube;

first means for conveying a dry substance into said mixing tube;

second means for conveying a liquid substance into said mixing tube;

third means for conveying a recirculated mixture of said dry and liquid substances into said mixing tube;

wherein said dry substance, said liquid substance and said recirculated mixture are delivered to a common point of intersection within said mixing tube such that a mixture is formed;

a deflector plate suspended below said mixing tube for reducing air entrapment in the mixture of said substances;

a mixing tub wherein a part of the apparatus is suspended therein, said tub having a partition over which the mixture of said substances flows when the mixture reaches a certain height in said tub; and wherein said deflector plate is positioned below a top of said partition.

23. A mixing apparatus, comprising:

a mixing tube having an attached collar;

first means for conveying a dry substance into said mixing tube wherein said first means includes a replaceable insert, said insert is received through a central opening of said collar until a flange of said insert engages an annular shoulder of said collar;

second means for conveying a liquid substance into said mixing tube wherein said second means includes a cylindrical wall having a bore defined therethrough, said wall having a liquid nozzle plate attached to an end thereof and a cut-out portion;

third means for conveying a recirculated mixture of said dry and liquid substances into said mixing tube wherein said third means includes a recirculation inlet angled toward a lower portion of said mixing tube, said recirculation inlet having a recirculation nozzle plate attached to an end thereof;

wherein said dry substance, said liquid substance and said recirculated mixture are delivered to a common point of intersection within said mixing tube such that a mixture is formed;

a deflector plate suspended below said mixing tube for reducing air entrapment in the mixture of said substances;

a mixing tub attached to the apparatus wherein a part of the apparatus is suspended therein, said tub having a partition over which the mixture of said substances flows when the mixture reaches a certain height in said tub;

wherein said deflector plate is positioned below a top of said partition;

a flow deflector located inside said mixing tube for enhancing the mixing of said substances therein; and a flow interceptor attached to said mixing tube for enhancing the mixing of said substances wherein said flow interceptor enhances mixing by intercepting a portion of said mixed substances from said flow deflector.

24. The apparatus of claim 23 wherein said insert is constructed of an ultra high molecular weight polyethylene.

25. The apparatus of claim 23 wherein said insert extends a distance in the range from about zero inches to about one inch below a lowest point of said second means for conveying.

26. The apparatus of claim 23 wherein a wrapped view of said cut-out portion is approximately rectangular in shape.

27. The apparatus of claim 23 wherein said liquid nozzle plate is a truncated circular shape and forms a gap oriented toward an upper portion of said mixing tube.

28. The apparatus of claim 23 wherein said cut-out portion is oriented toward a lower portion of said mixing tube.

29. The apparatus of claim 23 wherein said recirculation nozzle plate is semi-circular.

30. The apparatus of claim 23 wherein said recirculation nozzle plate has a diameter substantially the same as an outside diameter of said recirculation inlet.

31. The apparatus of claim 23 wherein said recirculation nozzle plate is positioned approximately flush with an inside surface of said mixing tube.

32. The apparatus of claim 23 wherein said flow deflector is a frusto conical shape and has a bore disposed therethrough.

33. The apparatus of claim 23 wherein said deflector plate is positioned approximately two inches below a top of said partition.

34. The apparatus of claim 23 wherein flow interceptor extends about 180° and said flow deflector extends about 360°.

35. The apparatus of claim 23 wherein flow interceptor is approximately equivalent to one-half the size of said flow deflector.

36. The apparatus of claim 23 wherein flow interceptor is flow interceptor positioned opposite said third means for conveying the recirculated mixture.

37. A mixing apparatus, comprising:

a mixing tube having an attached collar;

first means for conveying a dry substance into said mixing tube wherein said first means includes a replaceable insert;

said insert is received through an opening of said collar until a flange of said insert engages an annular shoulder of said collar; second means for conveying a liquid substance into said mixing tube;

wherein said insert extends a distance in the range from about zero inches to about one inch below a lowest point of said second means for conveying;

third means for conveying a recirculated mixture of said dry and liquid substances into said mixing tube; and wherein said dry substance, said liquid substance and said recirculated mixture are delivered to a common point of intersection within said mixing tube such that a mixture is formed.

38. The apparatus of claim 37 wherein said insert has a length within the range from about seven inches to about eight inches.

* * * * *